US006058742A

United States Patent [19]

Dalmau Guell

[11] Patent Number: 6,058,742

[45] Date of Patent: May 9, 2000

[54] CIRCULAR KNITTING MACHINE FOR KNITTED FABRICS

[75] Inventor: Jose Ma Dalmau Guell, Barcelona, Spain

[73] Assignee: Jumberca, S.A., Barcelona, Spain

[21] Appl. No.: 09/167,667

[22] Filed: Oct. 7, 1998

[30] Foreign Application Priority Data

Oct. 7, 1997 [ES] Spain ..... 9702082

[51] Int. Cl.[7] ..... D04B 15/54; D04B 9/30

[52] U.S. Cl. ..... 66/140 R

[58] Field of Search ..... 66/125 R, 133, 66/134, 145 R, 8, 13, 17, 19, 25, 26, 32, 33, 37, 140 R

[56] References Cited

U.S. PATENT DOCUMENTS

| | | | |
|---|---|---|---|
| 2,059,076 | 10/1936 | Aaronson | 66/145 R |
| 4,193,274 | 3/1980 | Gostelow | 66/140 R |
| 4,385,507 | 5/1983 | Sawazaki | 66/140 R |
| 4,539,825 | 9/1985 | Colosio | 66/24 |
| 5,046,333 | 9/1991 | Sawazaki et al. | 66/140 R |
| 5,070,709 | 12/1991 | Guell | 66/140 R |
| 5,186,027 | 2/1993 | Tenconi | 66/147 |
| 5,826,446 | 10/1998 | Plath et al. | 66/140 R |

FOREIGN PATENT DOCUMENTS

| | | | |
|---|---|---|---|
| 1585295 | 3/1963 | Germany | 66/145 R |

*Primary Examiner*—Danny Worrell
*Attorney, Agent, or Firm*—Nath & Associates; Gary M. Nath; Gregory B. Kang

[57] ABSTRACT

Circular knitting machine for knitted fabrics, comprising an assembly of needles which are mounted in rotary needle beds provided with cam sections which act on the needles to conduct them selectively according to alternative trajectories, while the yarns to be knitted are delivered in each section in a selective manner by a programmable feed mechanism, which incorporates a complementary assembly which comprises a lever (40) which can be actuated in connection with a tiltable cam (42), which incorporates another associated lever (44) able to be positioned in order to effect the actuation of a rod (50) which actuates cutting and clamping of the yarn being fed, independently of the introduction of a new yarn substituting for the previous one.

7 Claims, 10 Drawing Sheets

CIRCULAR KNITTING MACHINE FOR KNITTED FABRICS

FIELD OF THE INVENTION

The present invention relates to a circular knitting machine for knitted fabrics, with two needle beds, a plate and a cylinder, intended for the manufacture of lengths of outerwear, with separation pass, pattern effects and structural effects.

BACKGROUND OF THE INVENTION

The said type of machines are usually given the name "circular machines for sweaters," in which knitting takes place with an assembly of needles, conventionally mounted in rotary needle beds, with dial and cylinder.

The needles are functionally actuated by cam sections which act on the said needles, leading them selectively along alternative paths appropriate for the pattern which is to be knitted, in such a manner that before the action of the cams, each needle has been selected in each section of cams, to follow any of the possible paths in the said section.

In each knitting section, the needles which have been selected to work take up yarn from a yarn guide which, in its turn, receives the yarn from a feed mechanism (such as is known from U.S. Pat. No. 2,006,232), which can be programmed at each revolution of the machine to deliver one or more out of six possible yarns.

In the said circular machines, the fabric is conventionally produced in the form of a continuous tube, with a specific number of spirals of stitches, each fragment of spiral knitted in one revolution of the machine receiving the designation of "pass."

The number of passes which is knitted per revolution of the machine coincides with the number of sections of the machine, when in the revolution in question all the sections are configured as "Jacquard sections," and knit a plain fabric, each pass being knitted by all of the needles of the machine.

However, the number of passes knitted in one revolution decreases when there are inoperative sections and/or when a "Jacquard pattern" of various colors is knitted, and also when each section is configured as a transfer.

In the machines without feeds, the passes join together with no break in continuity, since there exists no beginning or end in the needle beds, because the needles are uniformly distributed over the whole perimeter.

In contrast, in conventional machines with feeds, the passes have a beginning and an end which are physically predetermined, in such a manner that the beginning determines the first needle which receives yarn after the change of yarn delivered by the feed, and the end determines the last needle which knits before a change of yarn is produced, both needles always being the same ones.

Between the last needle and the first needle there is in the needle beds a zone without needles, called a "needle-free zone," which corresponds to the space necessary for the feed to have, conventionally, the means necessary to withdraw, cut, and retain the yarn which has been knitted, and to present, deliver and dispense the yarn which is to be knitted as a continuation.

Fabric is not formed in the said needle-free zone, because there are no needles in it, and the yarn appears in the same in the form of floats, that is, without forming stitches, so that the floats extend between the last needle of the preceding pass and the first of that which follows, which correspond to the last and first physical needles of the needle bed.

Immediately after the needle-free zone, there is what is conventionally termed the "initial zone," which begins with the first needle after the needle-free zone and is formed by a very small number of needles (generally less than twelve) which knit what is called the "initial welt."

In the said initial welt, the needles simultaneously knit two yarns, which are the salient yarn and the recessed yarn, so that the process of fabric formation is given continuity, avoiding the production of a discontinuity when the yarn changes (change of feeds).

Before the needle-free zone, there is what is conventionally termed the "end zone," which is programmed for the needles to knit according to a selection which is suitable for forming the final welt.

The initial zone, needle-free zone and end zone form what is called the "change zone," while the initial and final welts give continuity to the knitted tube, counteracting and eliminating the discontinuity of the needle-free zone, so that to all intents and purposes the fabric is produced physically in the form of a tube, with the consistency and behavior of a homogeneous tube.

The said characteristics permit the actions of stretching, calendering, and rolling up the fabric, which can be effected in the same manner as in a circular machine without feeds. These three actions are exerted by the folding device of the machine, which receives the fabric produced in the form of a tube in the needle beds, and which calenders, flattens, and folds it in two, and which continuously receives it and rolls it up.

In flat bed knitting machines, the fabric is produced in a flat form, and there thus exist a physical beginning and end of the stroke, which permits the production of a fabric with variable width and/or with varied effects.

On the other hand, the effectiveness of the folder in flat bed machines is less, because of the discontinuity of the fabric (which has a beginning and end in each pass), aggravated by the transverse elasticity characteristic of knitted fabrics.

The advantages of variable width and structured fabrics, which the flat bed machines possess with respect to the circular machines, are distinguished by the following:

(a) The variable width consists of knitting with the exact number of needles which are necessary for obtaining the precise fabric width for making the garment which is to be knitted.

This feature eliminates waste in making up, because in each case it is the necessary knitted width which is produced, while in conventional circular machines this arrangement is not possible, due to the physical configuration, because the circular continuity of the needle bed favors and determines the continuity and magnitude of the width of the tube of fabric which is produced.

However, the discontinuity of the change zone in machines with feeds does not permit the said feature, because the first and last needles are always invariably determined.

(b) Structured fabrics are up to now an exclusive feature of flat bed machines, and are obtained by the controllable displacement of the relative position of the needle beds.

In one position, each needle of a needle bed is situated between two needles, which are always the same, of the opposed needle bed, in such a manner that in conventional circular machines the said position is unalterable and never changes, and the stitches of the knitted fabric are always produced in the same order; and in the case of stitch transfers, they are always produced between the same pairs of needles.

In contrast, in flat bed machines, the discontinuity of the process of knitting permits changing the relative position of the needle beds in the dead times which occur at the end of each stroke, and the order in which the stitches are produced can be varied and stitches transferred to different needles in different strokes.

This feature is facilitated in flat bed machines by the obligatory discontinuity of the knitting process at the end of each stroke; however, on the other hand, there is a reduction of the productive capacity, because the dead time always occurs, independently of whether or not the relative position of the needle beds changes in the stroke which develops.

SUMMARY OF THE INVENTION

Given all this, a circular knitting machine is proposed according to the present invention, of the "Sweaters" type, with multi-valued sections capable of producing fabrics of variable width and other effects, by the variation of the relative position of the needle beds.

According to the invention, there are included in the aforementioned machine improvements which affect the systems of feeds and yarn guides, by means of the incorporation of a set of levers which affect the functional behavior of the abovementioned systems, to deliver yarn, cancel feeds, and produce fancy effects.

On this basis, through simple means, a circular knitting machine capable of producing open fabric like that of flat bed machines and tubular fabric of variable width is obtained, thereby exhibiting a great advantage over conventional knitting machines.

DETAILED DESCRIPTION

Figure 1:
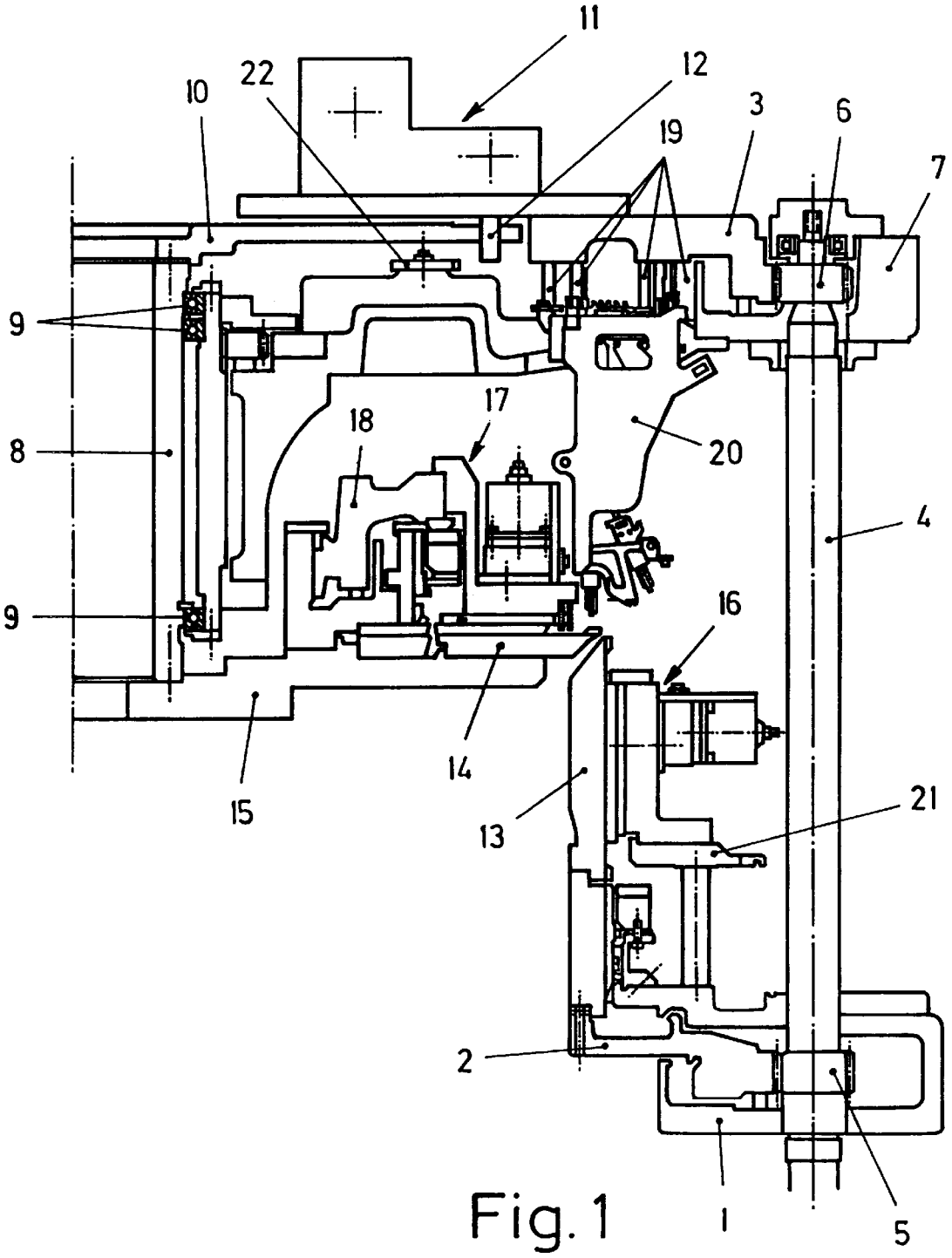
FIG. 1 is a sectional elevation view of the needle bed zone of a circular knitting machine which incorporates the improvements of the invention.

The invention has as its object a circular knitting machine for knitted fabrics, comprising a needle bed zone (FIG. 1) which comprises an upper ring (1), a cylinder support ring (2), an upper crown (3), a shaft (4) provided with a pinion (5, 6) at each end, a ring (7) termed a "tripod support," and a central shaft (8), with which are associated bearings (9) incorporated in the tripod support (7).

An arm (10) integral with the end of the shaft (8) is disposed in the upper part of this assembly; the said arm (10) faces a drive pin (12) integral with a mechanism (11) which is termed a "variator unit" and whose function is to vary, via interposed elements, the relative position of the needle cylinder (13) with respect to the needle dial (14).

The needle dial (14) is disposed on a support (15) and is provided with the cam sections (17) which in their turn have a support (18), so that the needle cylinder (13) includes cam sections (16) in its turn.

Cams and controls (19) are situated in the upper crown (3) in relation to the feeds, such as is shown by the reference numeral (20) in said FIG. 1.

In the same assembly, the reference numeral (21) indicates a body support ring for the cam sections (16), so that a crown (22) for actuation of the variator is integral with the tripod.

The needle beds of the needle cylinder (13) and of the needle dial (14) are conventionally rotatable, the movement being taken through the respective crowns (2, 3) so that the needle bed of the needle cylinder (13) rests directly on the crown (2), while the needle bed of the needle dial (14) is related to the crown (3) in the following manner:

The variator unit (11) is situated on the said crown (3), and acts through its drive pin (12) on the arm (10) integral in its turn with the support (15) on which the needle dial (14) is disposed.

The crowns (2, 3) receive movement through the pinions (5, 6) of the shaft (4), which is actuated by a motor (not shown); the central shaft (8) rotates on the bearings (9) incorporated into the tripod (7).

The cam sections (16) and (17) of the cylinder and needle dial are static and rest on their respective supports (21) and (18); the feeds (20) are mounted on the tripod (7) and are actuated by the cams and controls (19) situated on the crown (3).

Figure 2:
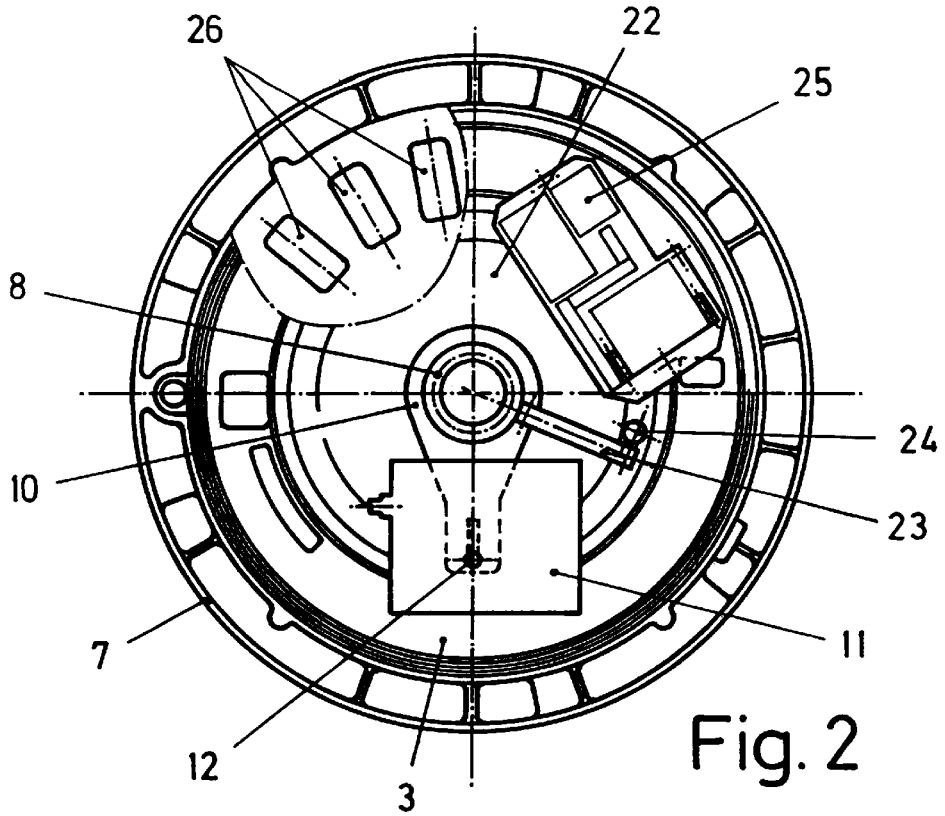
FIG. 2 is a plan view of the general disposition of the elements which are involved in the variable width systems and dial variation in the machines already known.

FIG. 2 shows in plan the general disposition of the elements which take part in the systems of variable width and dial variator; a support (23), on which is situated an encoder (24), can be seen, united to the arm (10).

The said encoder (24) generates signals which permit determination of the absolute instantaneous angular velocity of the needle dial (14), corresponding to the sum of the velocity at which the crown (3) rotates, plus or minus the differential velocity at which the variator mechanism (11) displaces the drive arm (10) with respect to the upper crown (3).

Incorporated in its turn on the said upper crown (3) is a box (25) containing the electronic components which control the variator mechanism (11).

In this FIG. 2, the abovementioned upper crown (3) is shown partially cut away to show the openings (26) of the tripod (7) which serve to lodge the feeds (20) so that via said openings (26) the feeds (20) are in operative relation to the cams-and to the controls (19) situated in the lower portion of the crown (3).

Figure 3:
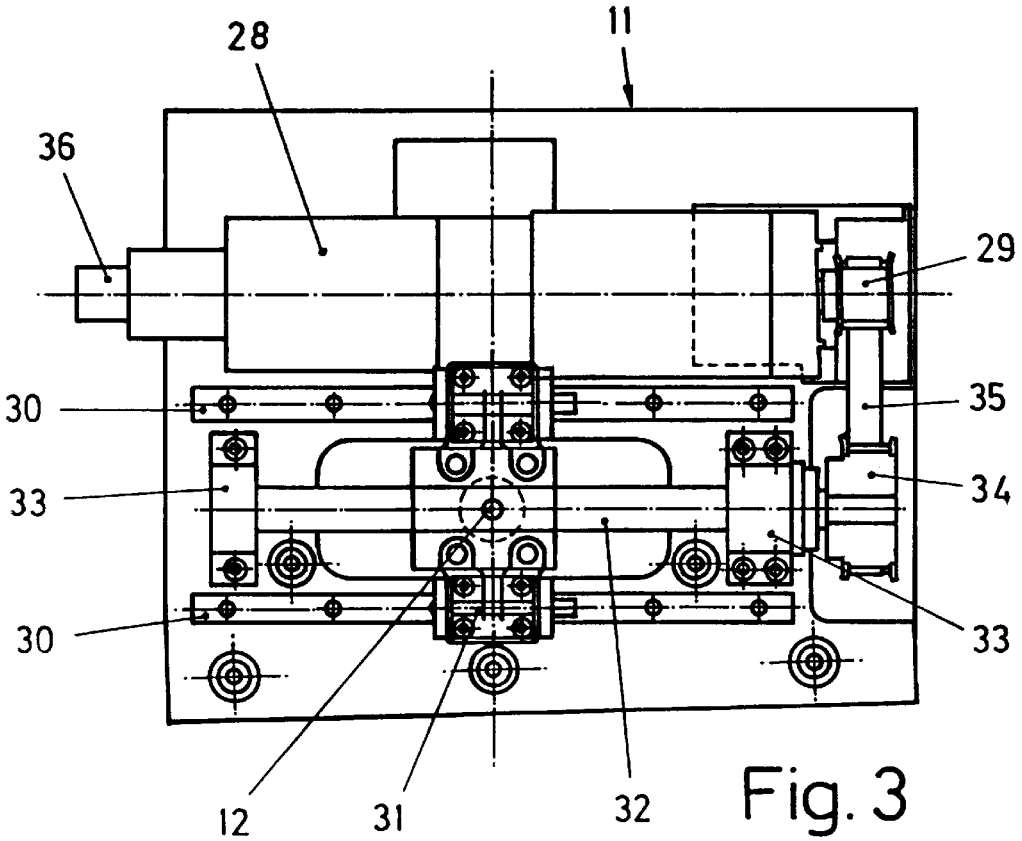
FIG. 3 is an enlarged detail of the mechanism, shown open, which corresponds to the dial variator.

The variator mechanism (11), which is shown in detail in FIG. 3, is made up of a support plate (27) on which is a direct current motor (28) having an encoder (36) coupled to its shaft, with which a pulley (29) is also integral, and is connected by a belt (35) to another pulley (34) integral with a spindle (32) which is mounted on one of the centering support bearings (33), while on the said shaft (32) there is mounted a movable nut (31) which slides along guides (30) and which incorporates an integral drive pin (12).

In this assembly, the movable nut (31) slides on the guides (30), driven by the spindle (32) which receives movement from the pulley (34) which in turn is driven by the belt (35) due to the rotation of the pulley (29) integral with the shaft of the motor (28).

Via the encoder (36), the control box (25) determines the position coordinate of the movable nut (31) with respect to its beginning position, and based on this, the main computer of the machine (not shown) sends to the said control box (25) the coordinate which corresponds to the position at which the nut (31) is to be situated and be maintained each time there is a dial variation operation.

On the other hand, the control box (25) furthermore determines, from the signals sent by the encoder (24), the absolute velocity at which the needle dial (14) is displaced, and as a function of the said box (25) controls, in its turn, the movement of the motor (28) in order to position the nut (31) at the selected coordinate in order to vary the position of the needle dial (14).

The action of the variator mechanism (11) on the needle dial (14) takes place in the following manner:

When the motor (28) rotates, the drive pin (12) is displaced, driving the arm (10) which, via the shaft (8) and the support (15), transmits its displacement to the needle dial (14), thereby varying the position of the said needle dial (14) with respect to the upper crown (3), and furthermore with respect to the cylinder support (2) of the needle cylinder (13), because the cylinder support (2) and the needle cylinder (13) are integral, in that the cylinder support (2) and the upper crown (3) always rotate in synchronism.

The operation of varying is carried out according to the following sequence:

#1—At the time for the needle-free zone, all the feeds (20) are canceled and yarn delivery ceases; the said cancellation is maintained during one revolution of the machine plus a fraction of 60°, because the first revolution of the machine is necessary to cut the yarns and put all the needles out of action on the periphery of the machine, while the following 60° is necessary to execute the action of varying.

#2—During the time that the feeds (20) remain canceled, the needles of the dial (14) and of the cylinder (13) are canceled, the cancellation being effected through a Jacquard selection system.

#3—The relative position of the needle cylinder (13) is varied with respect to the needle dial (14) by having the latter displace at a differential velocity with respect to the needle cylinder (13); in that the control box (25), through the information which is sent to it by the encoders (24) and (36), controls the movement in order for this to take place always in 60° of displacement of the needle beds, independently of the machine's velocity or whether it is in an acceleration, braking, or inoperative phase.

The said controller (25) likewise controls the absolute velocity of the needle dial (14) so that it is never negative, in such a manner that in case the position of the said dial (14) has to retrogress with respect to the needle cylinder (13), the relative displacement always occurs at a velocity less than the velocity of rotation of the machine, thus preventing the needles on the cam sections from going in a contrary direction.

#4—The operation of varying being completed, at its step for the needle-free zone, the feeds of the sections which are to form stitches again deliver yarn, and the corresponding needles are selected to receive it.

The operation of cutting yarn takes place automatically each time a yarn is introduced in substitution for a previous yarn, so that it is not possible to cease feeding with the conventional feeds, because to remove one yarn it is necessary to place another, so that it is not possible to cancel the feed.

The said form of operation is valid in machines with conventional feeds, in that it is necessary to insure the continuity of the knitting process, but it is not operative in the proposed machine according to the invention, because the knitting process is discontinuous in the latter, it being necessary to cease feeding yarn and, so, to cancel the feeds, while transferring or while varying the position of the needle dial (14).

Therefore, according to the invention, the feeds (20) are provided in a form which permits them to be selected to act according to two distinct work modes:

OPTION "A": in which the work mode is kept according to the conventional form, that is, the operation of cutting the yarn takes place automatically each time a yarn is introduced to substitute for the previous one.

OPTION "B": in which, without having to introduce a new yarn, the feed (20) can be canceled, cutting the yarn which was being fed.

Figure 4:
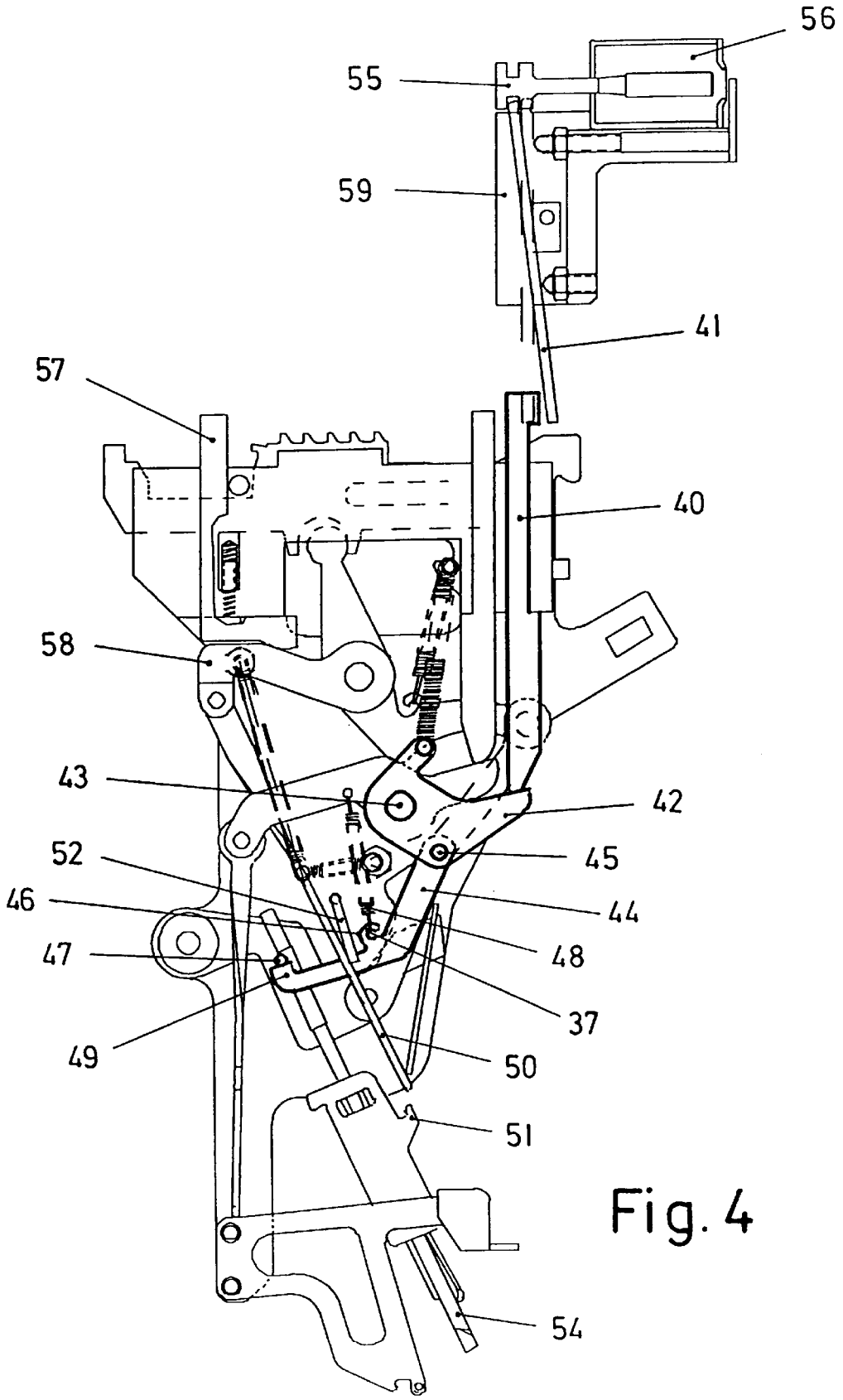
FIG. 4 is a diagram of a feed in which the portions which constitute the invention are shown detached and drawn with lighter lines, with the canceling lever in the inoperative position.
Figure 5:
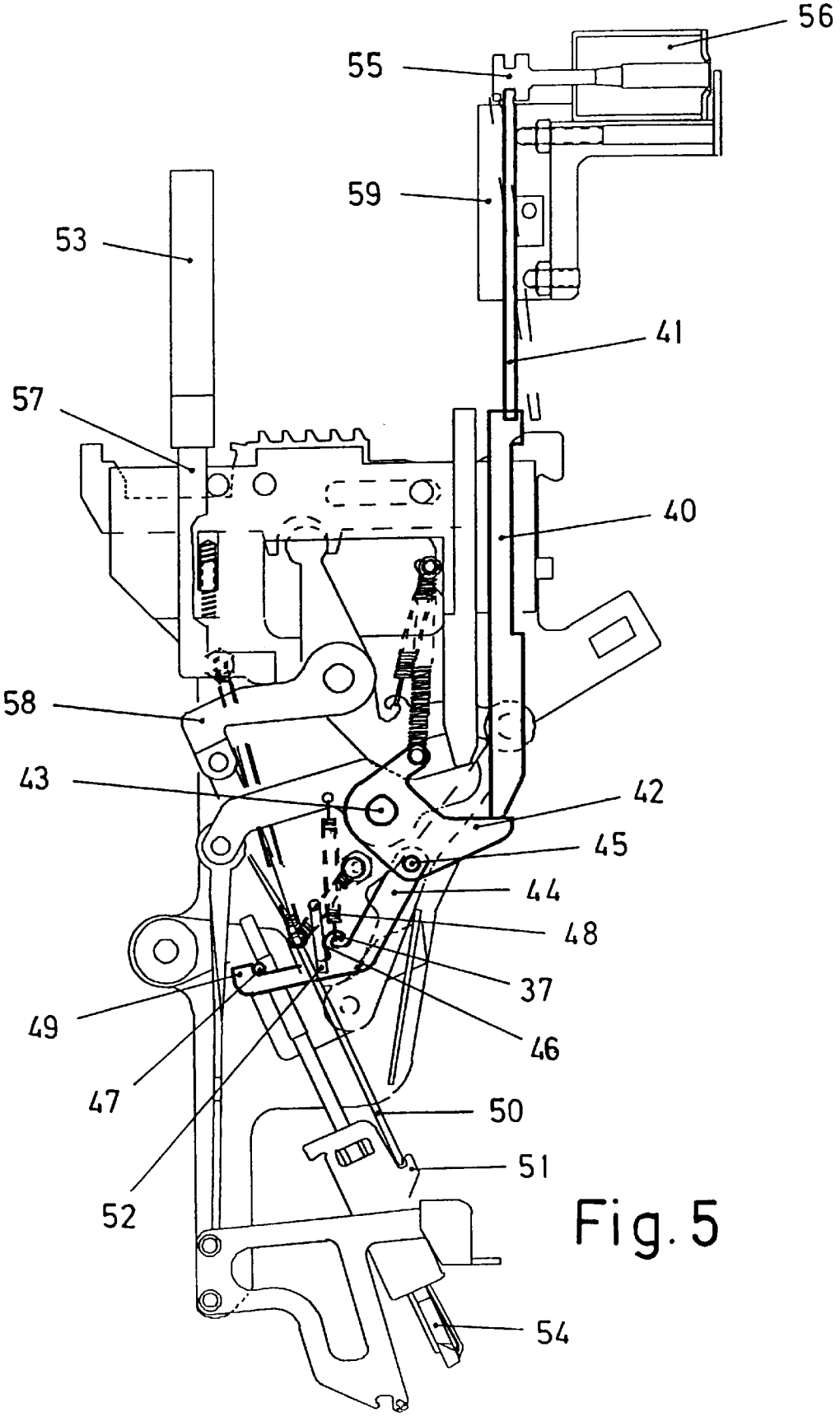
FIG. 5 is a diagram similar to the preceding one, but with the canceling lever in the operative position.
Figure 6:
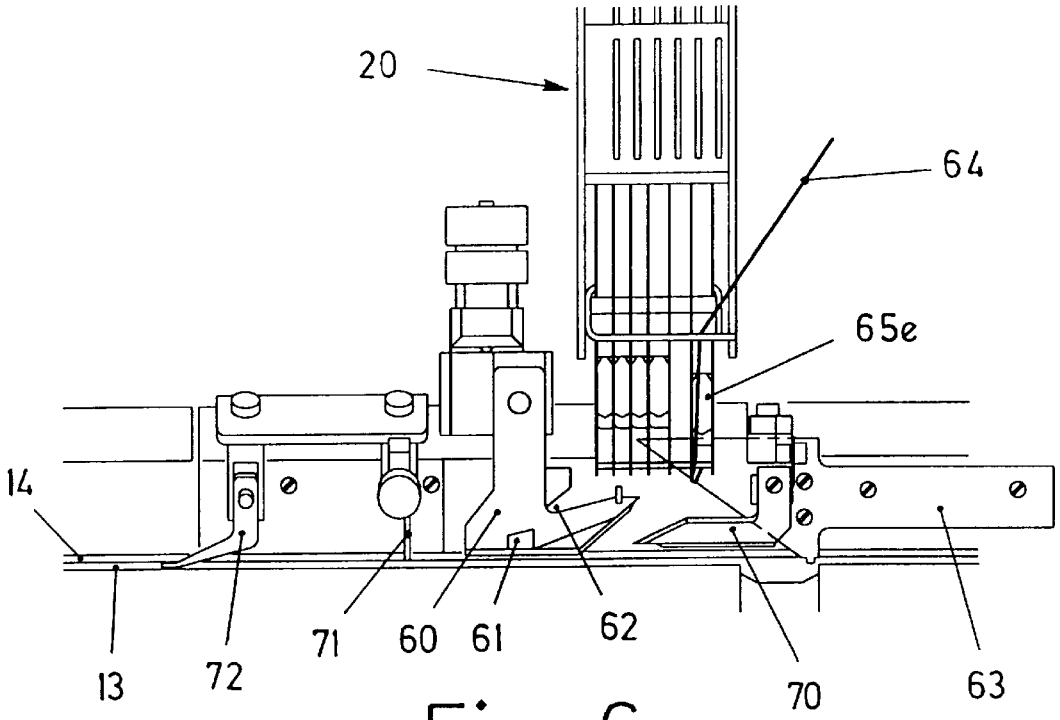
FIGS. 6–12 show the sequence of delivery of yarn by a feed which has been canceled and which returns to be canceled at the end of the corresponding revolution.
Figure 7:
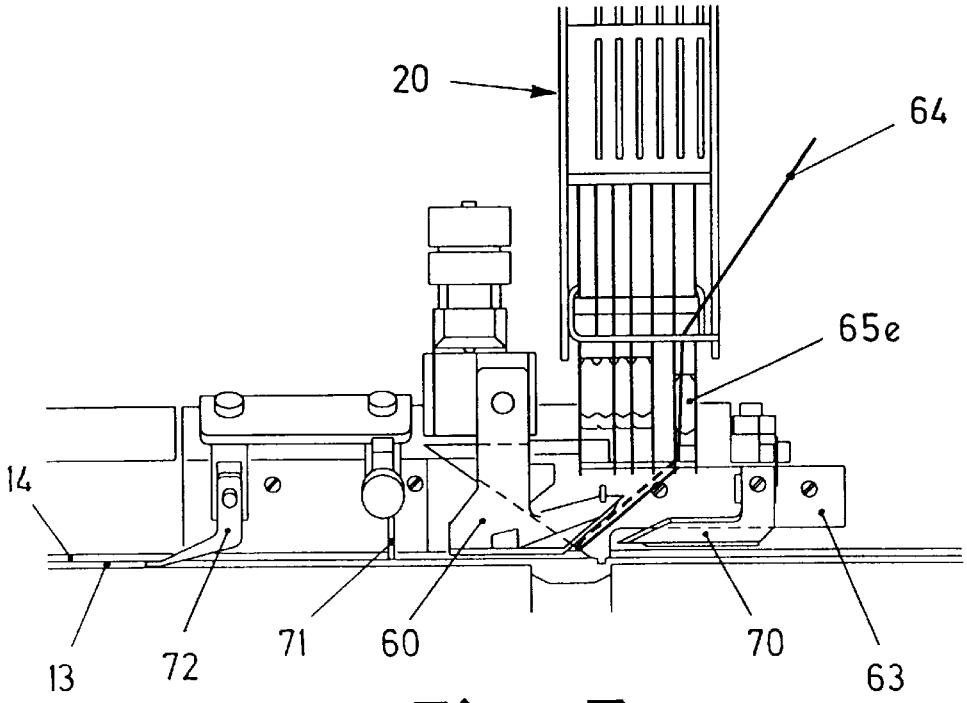
Figure 8:
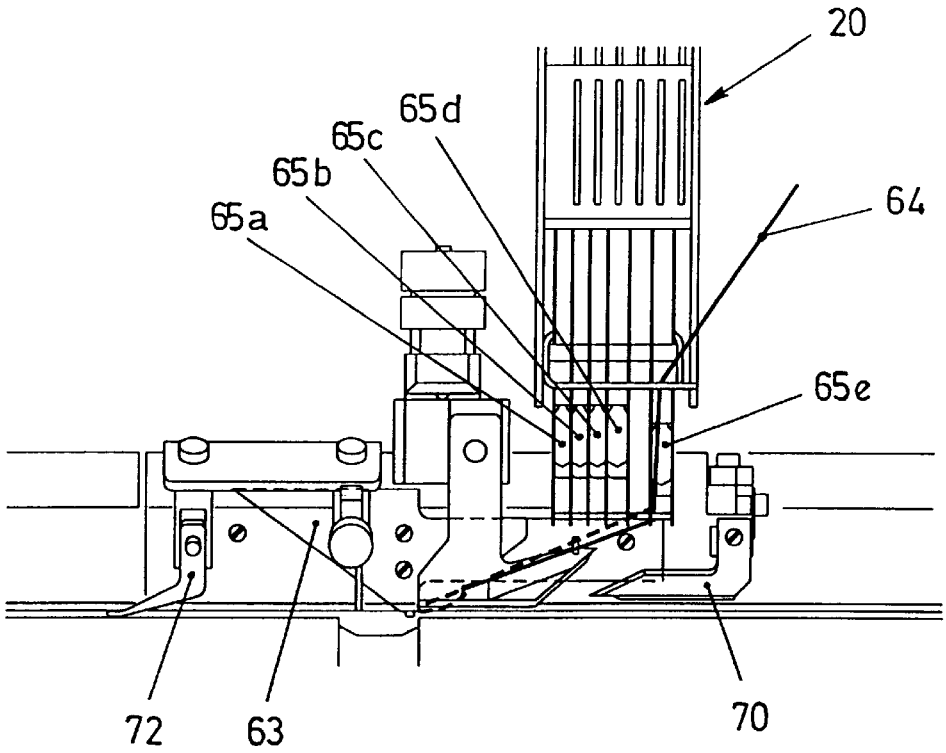
Figure 9:
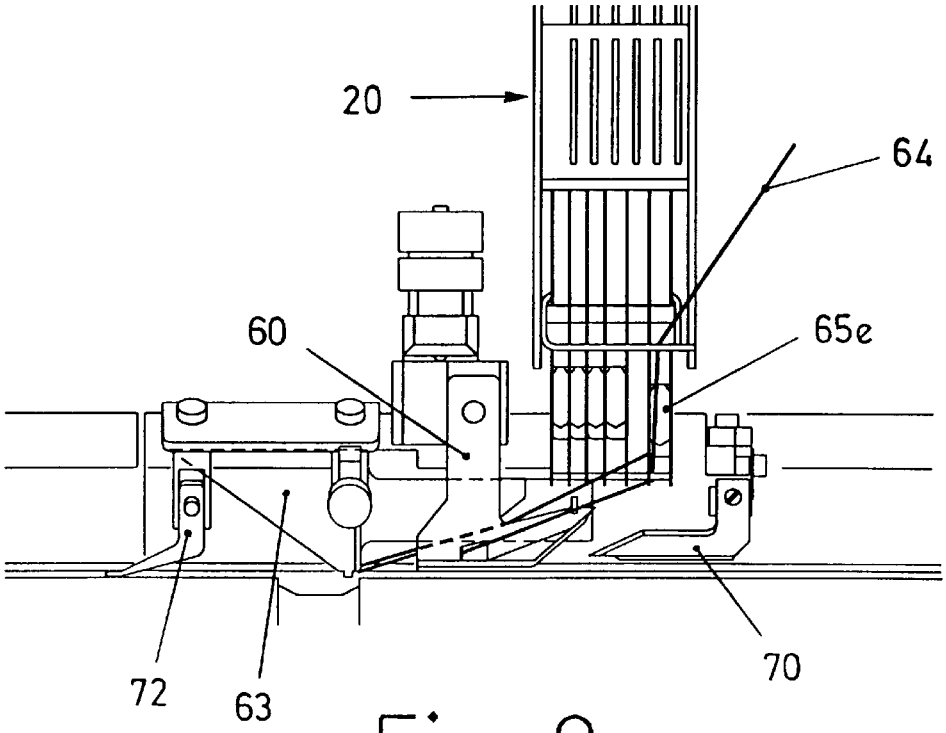
Figure 10:
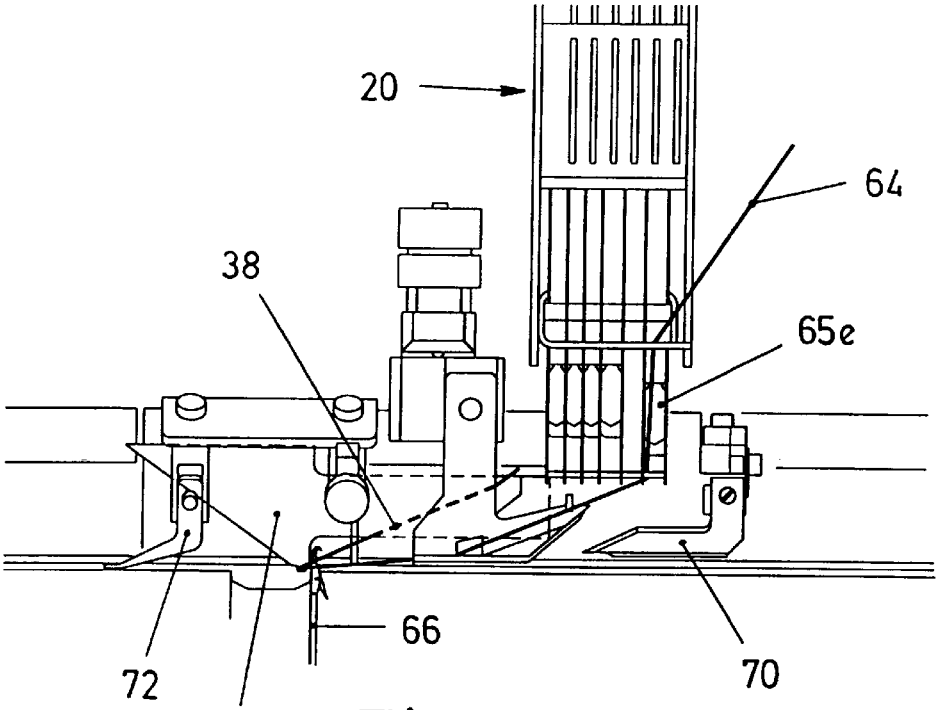

A modified feed (20) according to the invention can be seen in FIGS. 4 and 5, in which the portions constituting the novelty are shown with lighter lines, and consist of a canceling lever (40) which can be pushed by a rod (41), the said lever (40) resting on a tilt cam (42) which can rotate about a point (43) and on which there is articulated at a point (45) another lever (44) which has a coupling (37) engaged by a spring (48), while the external portion (46) of the said coupling (37) faces a suitable lever (52) of the conventional feed, this lever (44) having at the other end portion a coupling (49) by means of which it is possible to engage on a fixed pin (47).

A feed (20) according to the OPTION "A" is shown in FIG. 4, that is, with the canceling lever (40) in the inoperative position, so that the feed (20) behaves according to the conventional form of actuation, because its operation does not become altered by the presence of new elements which are the object of the invention.

FIG. 5 shows a feed (20) selected according to OPTION "B", related to which in the upper part are shown the canceling control (59) and a scissors cam (53), for variable width, which are integral with the upper crown (3) of the head of the machine, with the canceling control (59) occupying a fixed position with respect to the said crown (3), so that the scissors cam (53) is displaceable and can be situated where suitable for the width of fabric to be produced in each case.

On each revolution of the machine, the canceling control (59), together with the conventional cams and controls, actuates each time one of the feeds (20) to produce sequences of change, or no change, of the yarn and the canceling of the feeds (20).

The canceling control (59) consists of a bistable electromagnet (56), with a core (55) which acts on the push rod (41) in order to situate this in a free position with respect to the canceling lever (40), as in FIG. 4, or in an active position with respect to the said lever (40), as in FIG. 5.

In this latter position, the rod (41) acts against the lever (40), displacing it downward, upon which the cam (42) tilts and causes the lever (44) to advance and become engaged by means of its end coupling (49)) on the fixed pin (47), being maintained in this position by the action of the spring (48).

This displacement of the lever (44) causes the tilting of the lever (52) toward the left, situating it in exactly the same position that corresponds to when there is a yarn change in a conventional feed.

In the said position, the feed (20) becomes potentially canceled, the cancellation being finished at the moment at which the scissors cam (53) is actuated and acts on the lever

(57) which causes the cam (58) to tilt, pushing this to the rod (50) which comes into contact with the projection (51) of the movable yarn guide (54), resulting in the cutting and clamping of the yarn in the same form as when there is a yarn change. When this occurs without the delivery of a new yarn, the feed (20) is canceled.

Starting from the position described, when a new operation of yarn delivery occurs, the lever (44) automatically disengages from the pin (47), whereupon the feed (20) changes over to working in the standard manner, until the canceling lever (40) returns to being actuated.

The scissors cam (53) acts on all the feeds (20) on each revolution of the machine, with three possible results as a function of the configuration and selection of each feed (20):

(I) In a feed configured according to OPTION "A", that is, without yarn change, according to FIG. 3, the scissors cam (53) acts on the lever (57), this causes the cam (58) to tilt and the rod (50) descends, without as a result [sic] (51) coming into contact with the yarn guide (54), so that no action takes place as regards cutting and clamping of yarn.

(II) In a feed configured according to OPTION "A", but with a yarn change, the yarn change causes the lever (52) to tilt to the left, in the same way as in FIG. 4, so that the action of the scissors cam (53) on the lever (57) causes the cam (58) to tilt, upon which the rod (50) descends and deviates for the lever (52) to come into contact with the projection (50) of the yarn guide (54), the action of cutting and clamping the yarn therefore taking place.

(III) In a feed configured according to OPTION "B", that is, in a disposition of cancellation, without a yarn change, as in FIG. 4, the scissors cam (53) acts on the lever (57), which causes the cam (58) to tilt, whereupon the rod (50) descends, deviated by the lever (52), to come into contact with the projection (51) of the yarn guide (54), the action of cutting and clamping the yarn which was fed therefore taking place without substituting a new yarn, so that the feed (20) is canceled.

As has already been indicated, the scissors cam (53) is displaceable, able to be situated in the place which is appropriate for cutting the yarn at the level of what in each case is to be the "last needle" corresponding to the fabric width programmed.

According to the result of the actuation of the said scissors cam (53), as previously described, the fabric can be produced in three different forms:

Canceling all the feeds (20) at the end of each revolution, in order to change over to yarn delivery at the beginning of the next respective revolution. In this manner, the fabric which results is open, not tubular, analogously to that produced on a flat bed machine, with variable width.

Without canceling any of the feeds in any revolution. In this manner, the result is a tubular fabric, analogous to what is produced on a conventional feeder machine, with the difference that the dimension of the zone of floats (without stitches) is greater or less, as a function of the situation of the movable scissors cam (53), of variable width.

Combining cancellations of feeds with conventional changes of feeds. The fabric obtained in this manner is tubular and of variable width, partially united by floats.

FIGS. 6–12 represent the sequence of yarn delivery of a feed (20) which was canceled and which returns to be canceled at the end of the corresponding revolution; while FIGS. 13–17 reflect the sequence of the delivery of a yarn after a feed (20) is canceled.

In the said group of diagrams, the reference (60) corresponds to the principal yarn guide, provided with two grooves, the groove (61) for the reception of a single effect yarn (64) coming from the tilting yarn guides (65*a*), (65*b*), (65*c*), (65*d*) or (65*e*), and the groove (62) for the conventional reception of any yarn (64) delivered by the feed (20).

In the same diagrams, the reference (63) denotes a conventional cam for delivery of yarn (64), integral with the needle cylinder (13); while reference (66) corresponds to the first needle of the cylinder (13) which receives yarn (64), while (67) is the span of cylinder needles which receive yarn (64), and (68) is the last needle which receives and knits yarn (64).

The reference (69) indicates the needle-free zone between the last needle (68) and the first needle (66) of the needle bed, (70) being a conventional tongue opener; (71) denotes a conventional float guide, (72) a conventional stitch presser, (38) the end of the yarn (64) retained by the feed (20), and (39) a deflecting rod which intervenes over the yarn (64) which one of the tilting yarn guides (65*a–e*) delivers and conducts to the groove (62).

According to the sequence of FIGS. 6–12, the feed (20) which was canceled, that is, which was delivering no yarn to the needles, is selected for the delivery of the yarn (64) retained by the tilting yarn guide (65*e*). The cam (63) receives, in a conventional manner, the end (38) of the yarn (64) presented by the tilting yarn guide (65*e*) and conducted to the groove of the principal yarn guide (60), from where it is received, in a conventional manner, by the first needle (66).

Figure 11:
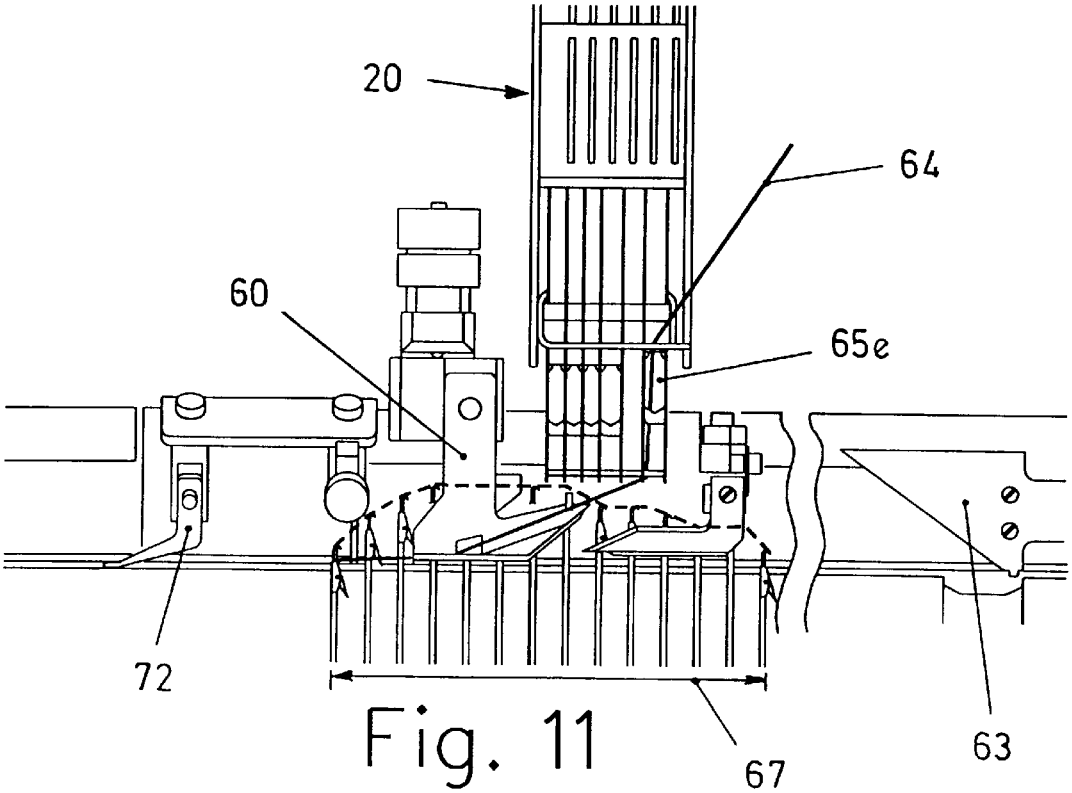
Figure 12:
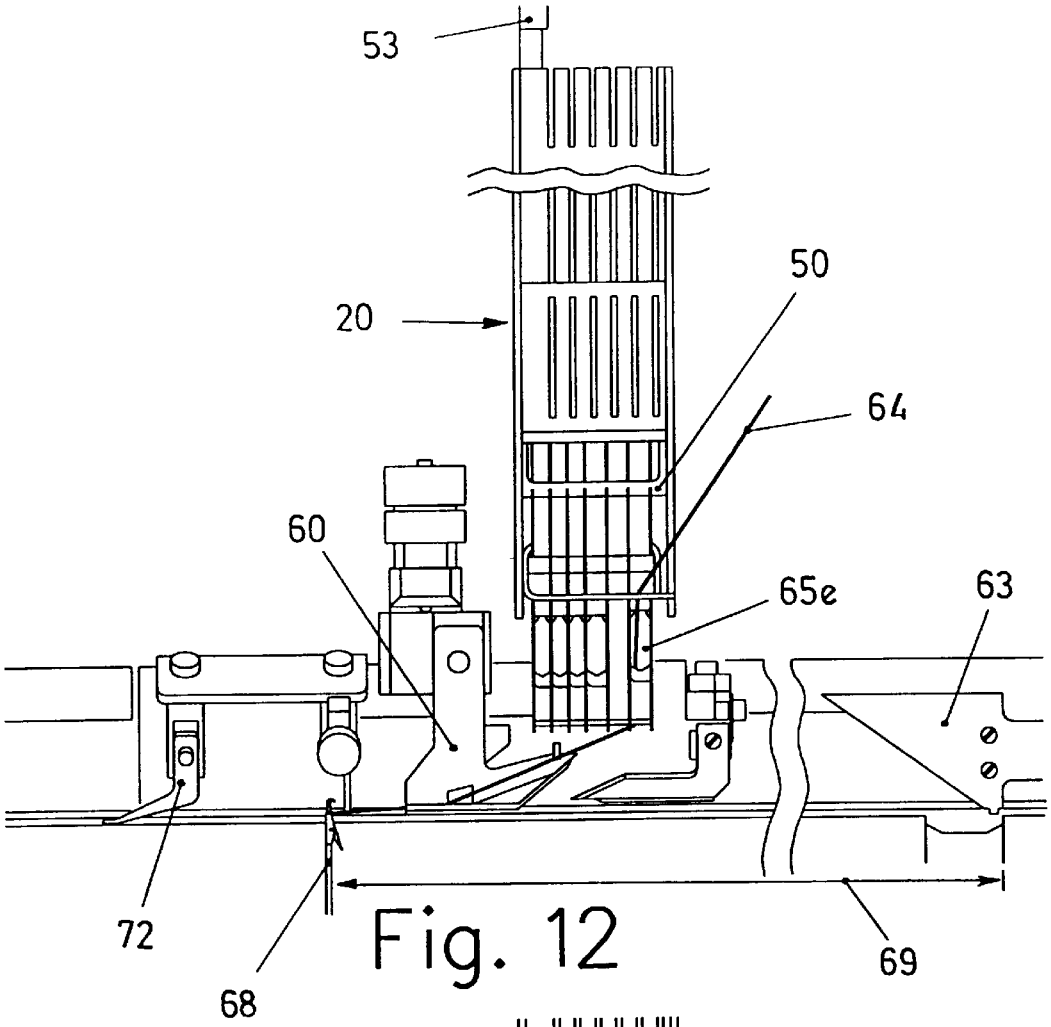
Figure 13:
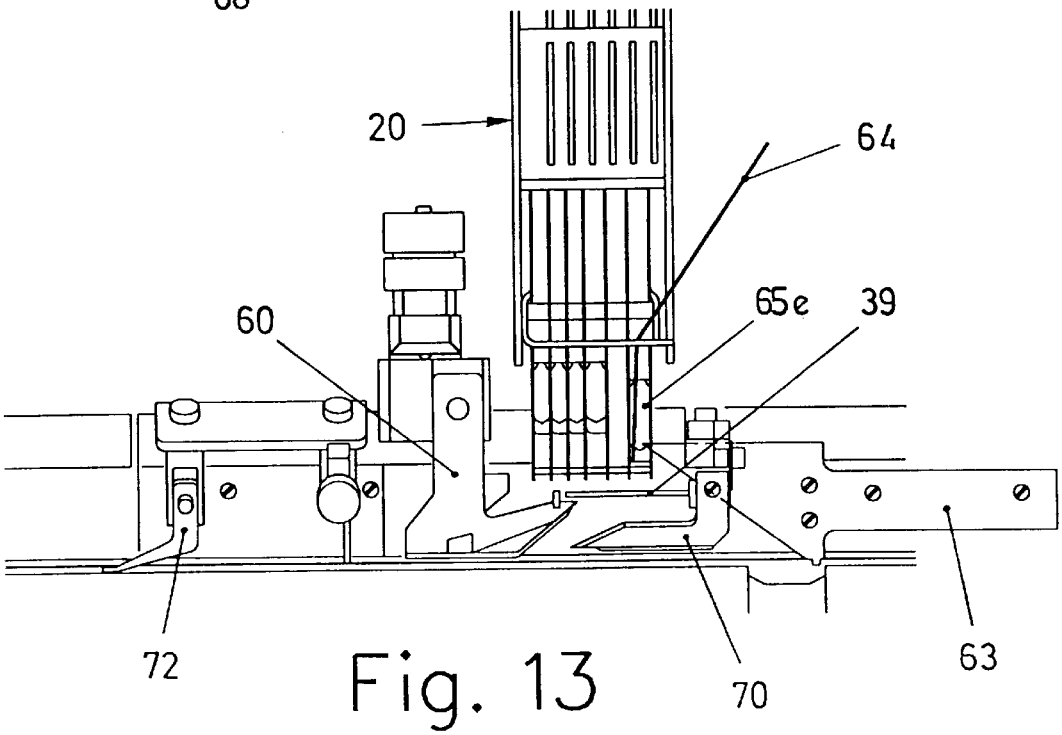
FIGS. 13–17 show the sequence of delivery of yarn from a canceled feed.
Figure 14:
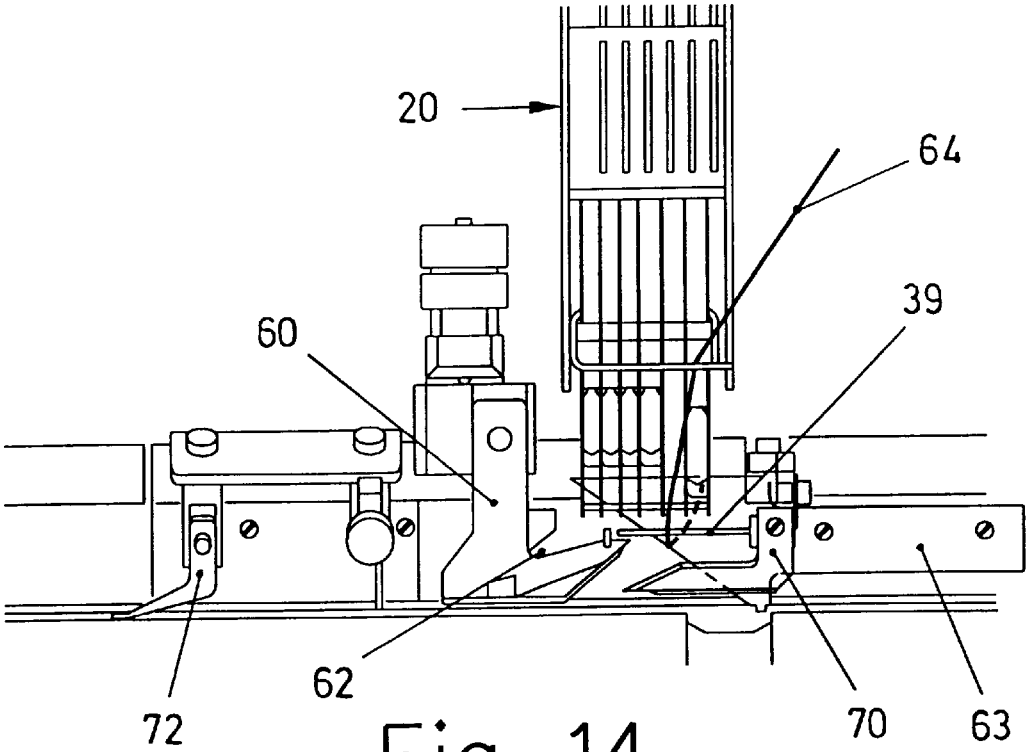
Figure 15:
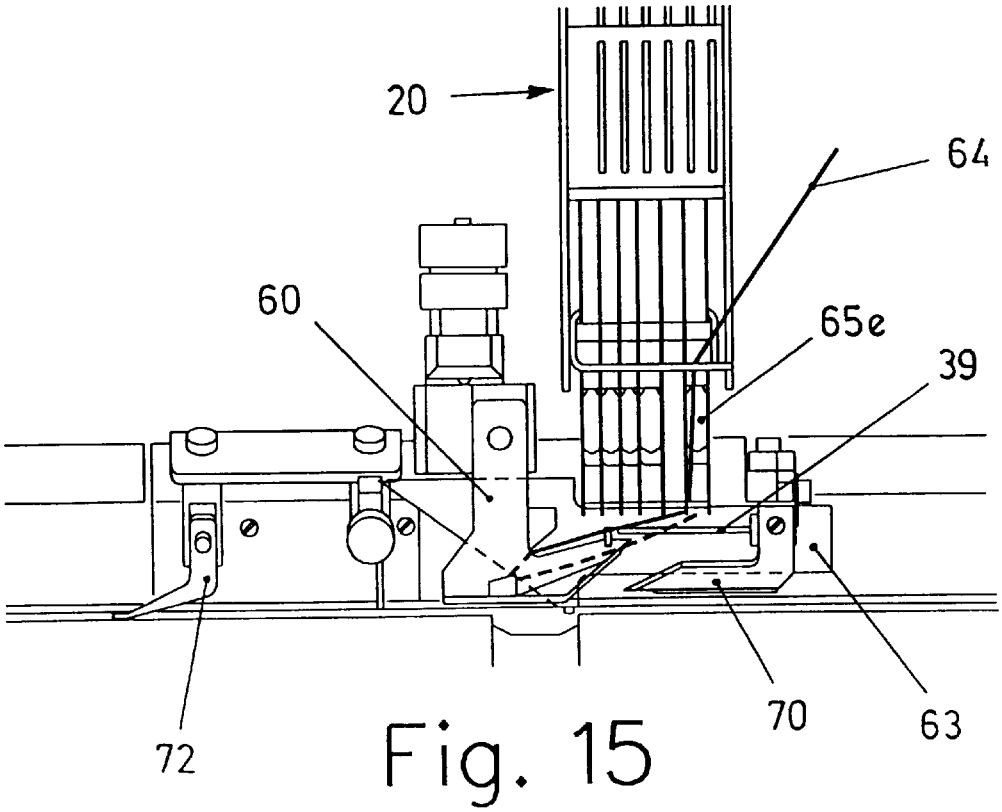
Figure 16:
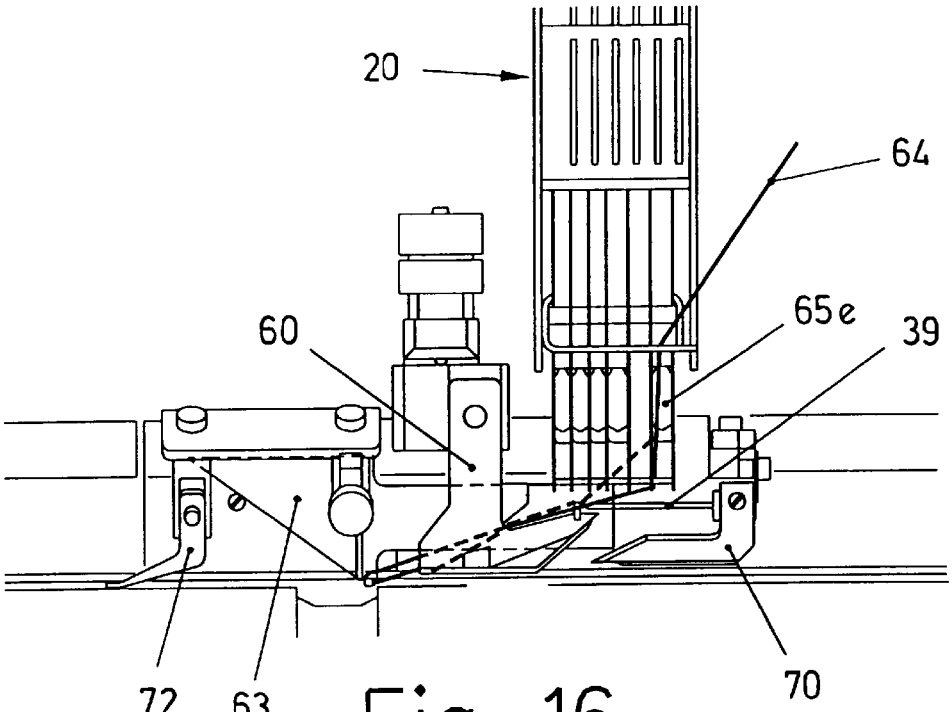
Figure 17:
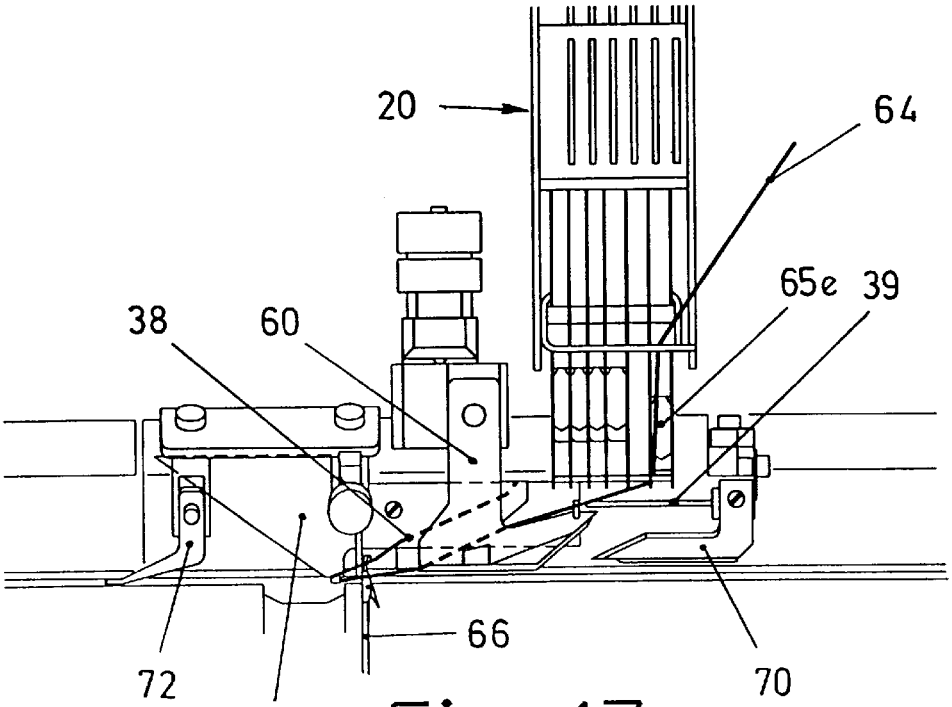

The needles which follow this first one (66) likewise receive the yarn (64) following the sequence (67) of FIG. 11, so that when the last needle (68) receives the yarn (64), the cutter bar (50) descends, actuated by the intermediate levers which connect it to the scissors cam (53), cutting and clamping the yarn (64) in accordance with what was described herein above.

In FIGS. 13–17, the sequence of delivery of a yarn (64) from a canceled feed (20) is repeated; in this case, however, delivery of the yarn (64) is by the tilting yarn guide (65*e*), but the presence of the deflecting rod (39) leads it to the groove (62) of the principal yarn guide (60).

The yarns (64) delivered to the needles through the grooves (61) or (62) are received by the needles in different positions in the interior of their hooks, to be knitted in a regular manner so that one of the yarns (64) appears on one face of the fabric and the other yarn on the other face.

I claim:

1. A circular knitting machine for knit fabrics of the type that includes a series of needles mounted in revolving needle beds provided with sections of cams that selectively lead the needles through alternative paths while threads to be knitted are delivered in each section of cams in a selective manner by a programmable stripping mechanism wherein the programmable stripping mechanism comprises:

an operable lever;

a tilting cam operated by said operable lever;

an operable bar that activates the cutting and nipping of the threads to be knitted independently of the introduction of a new thread to replace a thread to be knitted; and an associated lever which can be positioned upon the operation of said tilting cam so as to permit the operation of said operable bar.

2. A circular knitting machine as claimed in claim 1 further comprising:

a controller; and a push bar that operates said operating lever and is in turn operated by said controller between an activating position and a disassociated position so as to either respectively operate said operating lever or not operate said operating lever.

3. A circular knitting machine as claimed in claim 1 and further including a fixed pin; and wherein said associated lever further comprises a hitch capable of engaging said fixed pin to maintain an advanced operative position of said associate lever.

4. A circular knitting machine as claimed in claim 3 wherein said associated lever has a remote end; and wherein said hitch is located at said remote end and is capable of clamping said fixed pin.

5. A circular knitting machine as claimed in claim 4 and further comprising a spring; and wherein said associated lever further comprises a further hitch, said spring acting on said further hitch to clamp said associated lever in an advanced operative position.

6. A circular knitting machine as claimed in claim 1 and further comprising a spring; and wherein said associated lever comprises a hitch, said spring acting on said hitch to clamp said associated lever in an advanced operative position.

7. A circular knitting machine as claimed in claim 1 further comprising:

an operating scissors cam capable of being positioned to cut the threads to be knitted according to a selected width of a fabric as programmed in each case, said operating scissors cam being movable and being in a working relationship to said operable bar.

* * * * *